US010948186B2

(12) United States Patent
Maniglier et al.

(10) Patent No.: US 10,948,186 B2
(45) Date of Patent: Mar. 16, 2021

(54) LIGHTER ABLE TO EMIT TWO DIFFERENT FLAMES ALTERNATELY

(71) Applicant: ST DUPONT, Paris (FR)

(72) Inventors: Pascal Maniglier, Montmin (FR); Anthony Chevy, Coise Saint Jean Pied Gauthier (FR); Christophe Turco, Chambery (FR); Sylvie Foucher, Annecy (FR)

(73) Assignee: ST DUPONT, Paris (FR)

( * ) Notice: Subject to any disclaimer, the term of this patent is extended or adjusted under 35 U.S.C. 154(b) by 89 days.

(21) Appl. No.: 16/026,249

(22) Filed: Jul. 3, 2018

(65) Prior Publication Data

US 2019/0011128 A1 Jan. 10, 2019

(30) Foreign Application Priority Data

Jul. 7, 2017 (FR) ..... 17 56438

(51) Int. Cl.
*F23Q 2/16* (2006.01)

(52) U.S. Cl.
CPC ..... *F23Q 2/165* (2013.01); *F23Q 2/161* (2013.01)

(58) Field of Classification Search
CPC . F23Q 2/165; F23Q 2/161; F23Q 2/06; F23D 23/00; F23D 1/06
See application file for complete search history.

(56) References Cited

U.S. PATENT DOCUMENTS 2,461,890 A * 2/1949 Fox ..... F23Q 2/06 431/134
2,497,137 A * 2/1950 Rodanet ..... F23Q 2/06 431/143
2,692,490 A * 10/1954 Florman ..... F23Q 2/162 431/130
3,063,276 A * 11/1962 Cassan ..... F23Q 2/162 431/254
3,228,215 A * 1/1966 Racek ..... F23Q 2/162 431/130

(Continued)

FOREIGN PATENT DOCUMENTS

FR 2 429 969 1/1980
GB 1199655 A * 7/1970 ..... F23Q 2/161

(Continued)

OTHER PUBLICATIONS

International Search Report dated Feb. 26, 2018.

*Primary Examiner* — Jorge A Pereiro
(74) *Attorney, Agent, or Firm* — IPSILON USA, LLP

(57) ABSTRACT

A lighter (1) has a container (16) of gas, a first gas circuit (26) intended to produce a first type of flame (2) and a second gas circuit (24) intended to produce a second type of flame (3). The lighter (1) further has a driver (6) associated with a mechanism (14, 15) for producing sparks, activation in rotation of said driver (6) generating sparks. The driver (6) is mounted in the lighter (1) to be mobile in translation between a nominal first position in which it holds the first circuit (26) open in order to allow the gas from the container (26) to pass through the first circuit (26) and thus to obtain the first type of flame (2). A second position is provided in which it blocks the first circuit (26) in order to allow the gas from the container (16) to pass through the second circuit (24) and thus to obtain the second type of flame (3).

12 Claims, 4 Drawing Sheets

(56) References Cited

U.S. PATENT DOCUMENTS

| | | | | | |
|---|---|---|---|---|---|
| 3,443,877 | A * | 5/1969 | Inagaki | F23Q 2/161 | 431/134 |
| 3,782,882 | A | 1/1974 | Goto | | |
| 4,209,977 | A | 7/1980 | Yoshinaga | | |
| 4,654,002 | A * | 3/1987 | Hartford | F23Q 2/173 | 431/254 |
| 4,884,965 | A | 12/1989 | Nitta | | |
| 5,584,681 | A * | 12/1996 | Suzuki | F23Q 2/163 | 431/132 |
| 6,537,062 | B1 * | 3/2003 | Wong | F23Q 2/161 | 431/133 |
| 6,884,063 | B2 | 4/2005 | Wong | | |
| 2003/0003412 | A1 * | 1/2003 | Chung Yang | F23Q 2/164 | 431/153 |
| 2003/0129556 | A1 * | 7/2003 | Xu | F23Q 2/287 | 431/255 |
| 2004/0096793 | A1 * | 5/2004 | Wong | F23Q 2/162 | 431/278 |
| 2005/0181320 | A1 * | 8/2005 | Vitantonio | F23Q 2/162 | 431/277 |
| 2006/0024631 | A1 * | 2/2006 | Wong | F23Q 2/163 | 431/255 |

FOREIGN PATENT DOCUMENTS

| | | | | |
|---|---|---|---|---|
| GB | 1 426 566 | | 3/1976 | |
| JP | S61 49933 | | 3/1986 | |
| WO | WO-03044432 | A1 * | 5/2003 | F23Q 2/165 |

* cited by examiner

LIGHTER ABLE TO EMIT TWO DIFFERENT FLAMES ALTERNATELY

RELATED APPLICATION

This application claims the benefit of priority from French Patent Application No. 17 56438, filed on Jul. 7, 2017, the entirety of which is incorporated by reference.

BACKGROUND

Description of Related Art

The invention relates to a lighter able to emit two different flames alternately.

Some lighters are designed to be able to emit alternately a classic yellow flame and a turbo flame or blue flame, which is like a weakly dispersed cone and is obtained with a higher gas exit velocity. The yellow flame is generally sufficient to light a cigarette or a cigar, the turbo flame being more intended to heat locally and rapidly a specific zone of a cigar, for example to relight it rapidly.

The lighters available on the market at present enabling these two types of flame to be obtained alternately necessitate the presence of two distinct buttons, each being specifically dedicated to obtaining a very specific flame. Now, a major disadvantage of this type of lighter is that the passage from one flame to the other is complicated because it involves either modifying the position of the lighter in the hand in order to be able to access the required button or manipulating said lighter with both hands. In the former case the lighter may escape from its user and fall to the ground. In the second case the user has to carry out difficult manipulations because their two hands are already occupied with the manipulation of the lighter whilst the user must moreover control a cigarette or a cigar.

For example, the application U.S. Pat. No. 6,884,063 describes a lighter able to provide two different types of flames, a classic yellow flame and a windproof flame. The yellow flame is produced by means of an ignition device involving a thumbwheel and a flint and the windproof flame is produced with the aid of an electronic ignition mechanism.

OBJECTS AND SUMMARY

A lighter according to the invention enables two different flames to be produced alternately without the described disadvantages of prior art lighters.

The invention consists in a lighter comprising a container of liquid fuel, a first gas circuit intended to produce a first type of flame and a second gas circuit intended to produce a second type of flame, said lighter further comprising a driver associated with a mechanism for producing sparks, activation in rotation of said driver generating sparks.

The principal feature of a lighter according to the invention is that the driver is mounted in the lighter to be mobile in translation between a nominal first position in which it holds the first circuit open in order to allow the liquid fuel from the container to pass through said first circuit and thus to obtain the first type of flame and a second position in which it blocks said first circuit in order to allow said liquid fuel to pass through the second circuit and thus to obtain the second type of flame. The term "driver" designates the member, which is generally of cylindrical shape, and that is turned by a sudden movement of the thumb, in order to generate sparks and to obtain a flame instantaneously. The principle of a lighter of the above kind is to render this driver multifunctional by adding to it in addition to its function of producing sparks the function of switching between the two gas circuits. In this way, by moving the driver in translation in the lighter, by means of a simple push preferably applied by the thumb, a user can, at will, easily select the first or the second type of flame as a function of what they require. The user does not need to modify the position of the lighter in their hand, either to produce sparks or to switch the two circuits, because these two functions are concentrated in the driver. A gas circuit generally delimits a gas passage leading to a diffusion element at the level of which the flame is formed, and said passage may include a number of members intended to act on the flow rate of the gas. The diffusion element is also termed a burner. All the elements operating in the lighter to be able to accomplish all the functions of the driver are preferably arranged in a compact manner to enable said lighter to retain a substantially constant size relative to those of existing lighters. The term "nominal position" means "position occupied by default". In other words, if the driver is not subjected to any movement in translation by the user, it is the first gas circuit that will always be active to obtain the first type of flame. The inside diameter of the first circuit is preferably greater than the inside diameter of the second circuit so that the fuel gas will as a priority take the first circuit. A particular type of flame is the result of a specific gas flow rate and a given gas dispersion. It is important to emphasize that a lighter according to the invention is able to provide two different types of flame alternately, said two types of flame never being produced simultaneously.

The first circuit advantageously comprises a blocking member including at least part of the first circuit and mobile between a position opening and a position closing said first circuit and the driver is in contact with said blocking member so that by default in the nominal first position the driver holds the blocking member in the opening position and so that movement in translation of said driver to its second position generates movement of the blocking member of the same amplitude to the closing position. The closing position of the blocking member corresponds to a position in which said member blocks the first circuit and renders it inactive and the opening position corresponds to a position in which it opens said first circuit. In other words, the driver exerts a push directly on the blocking member and therefore controls directly the opening or the closing of the first circuit. The blocking member may include either only a part of the first circuit able to provide the first type of flame or the whole of said first circuit.

The blocking member is preferably associated with a preloaded spring enabling said blocking member to be held by default in the opening position and consequently the driver to be held by default in its first position. As the blocking member is in contact with the driver, it is the spring that holds the driver in its first position.

Movement of the driver from its nominal first position to its second position preferably generates movement of the blocking member to its closing position accompanied by compression of the spring. In this way, the movement in translation of the driver necessitates a low force to overcome the force of the spring, making it possible to have better control over the movement of said driver. If the user removes the pressure on the driver, the latter returns immediately to the first position when the spring expands.

The maximum travel of the driver between the first position and the second position is advantageously between 0.5 mm and 3 mm inclusive. The travel of the driver is limited to enable easy and well controlled switching between the two gas circuits.

The driver is advantageously an elongate cylindrical member and the movement in translation of said driver in the lighter is advantageously effected along its revolution axis.

The first type of flame is preferably a yellow flame and the second type of flame is preferably a turbo flame. A yellow flame is characterized by a gas escape velocity of the order of a few m/s, an air/gas mixture being formed after leaving the orifice (burner), and a gas outlet diameter of a few tenths of a millimetre (for a double flame). A turbo flame is characterized by a gas escape velocity exceeding around 100 m/s, an air/gas mixture being formed before the gas leaves the orifice, and a gas outlet diameter of the order of 75 μm.

The first circuit preferably terminates at a first diffusion element at the level of which the yellow flame is produced, the second circuit terminating at a second diffusion element at the level of which the turbo flame is produced, said two elements emerging from the same face of the lighter, the second element emerging at a height greater than that of the first element. The two flames are formed at the level of the same wall of the lighter, the turbo flame being produced at a height greater than that of the yellow flame. This height difference is justified in that the yellow flame, which is the one lit by default in the lighter, contributes to forming the blue flame.

The first diffusion element preferably has two distinct orifices able to produce a yellow flame in two continuous parts, one of the two parts of said yellow flame having a particular orientation enabling it to initiate the turbo flame. In this way, the yellow flame is divided into two distinct but continuous parts, said parts being judiciously disposed to enable reversibility of the two types of flame. The two orifices of the first diffusion element are preferably placed at 75° to one another. The part of the yellow flame intended to initiate the turbo flame is advantageously disposed at 45° to said turbo flame.

The height difference between the first diffusion element and the second diffusion element is advantageously between 1 mm and 3 mm inclusive. This kind of height difference enables easy and systematic initiation of the turbo flame by the yellow flame, and vice versa.

The container of liquid fuel is advantageously blocked by a closing element, the lighter including a pivoting cap connected to said closing element by a rigid relay member so that opening the cap drives movement of the closing element to release the gas to the first circuit and the second circuit.

The invention secondly consists in a method of using a lighter according to the invention.

The principal feature of a method according to the invention is that it comprises the following steps,

- a step of filling the container of the lighter with a liquid fuel,
- a step of opening the cap in order to release the gas to the first and second circuits of the lighter,
- a step of rotating the driver so as to produce sparks and to obtain the first type of flame,
- a step of movement of the driver in translation between the first position and the second position in order to block the first circuit and to activate the second circuit in order to obtain the second type of flame.

The third step is reversible, because by returning the driver from the second position to the first position the first circuit is activated again to produce the first type of flame. The alternation from one flame to the other may be effected as many times as liquid fuel remains in the container.

The lighter according to the invention has the advantage of having the particular function of producing two different flames alternately, thanks to easy and well-controlled manipulation with one hand. In fact, the two flames are produced by means of a single member, namely the driver, which can be moved in rotation or in translation by the thumb of the same hand. It further has the advantage of remaining of constant overall size relative to existing lighters that do not have this two-fold function of producing two different flames alternately.

BRIEF DESCRIPTION OF THE DRAWINGS

A detailed description of a lighter according to a preferred embodiment of the invention is given hereinafter with reference to the following figures.

Figure 8A:
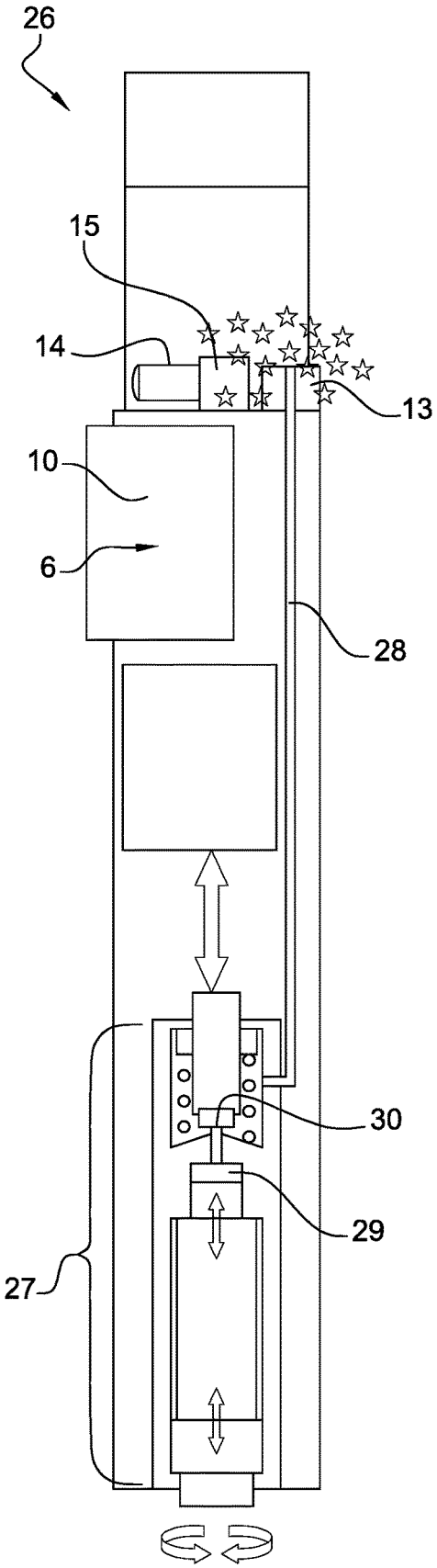
FIGS. 8A and 8B are two views in section of a first circuit able to produce a yellow flame and a second circuit able to produce a blue flame, respectively.
Figure 8B:
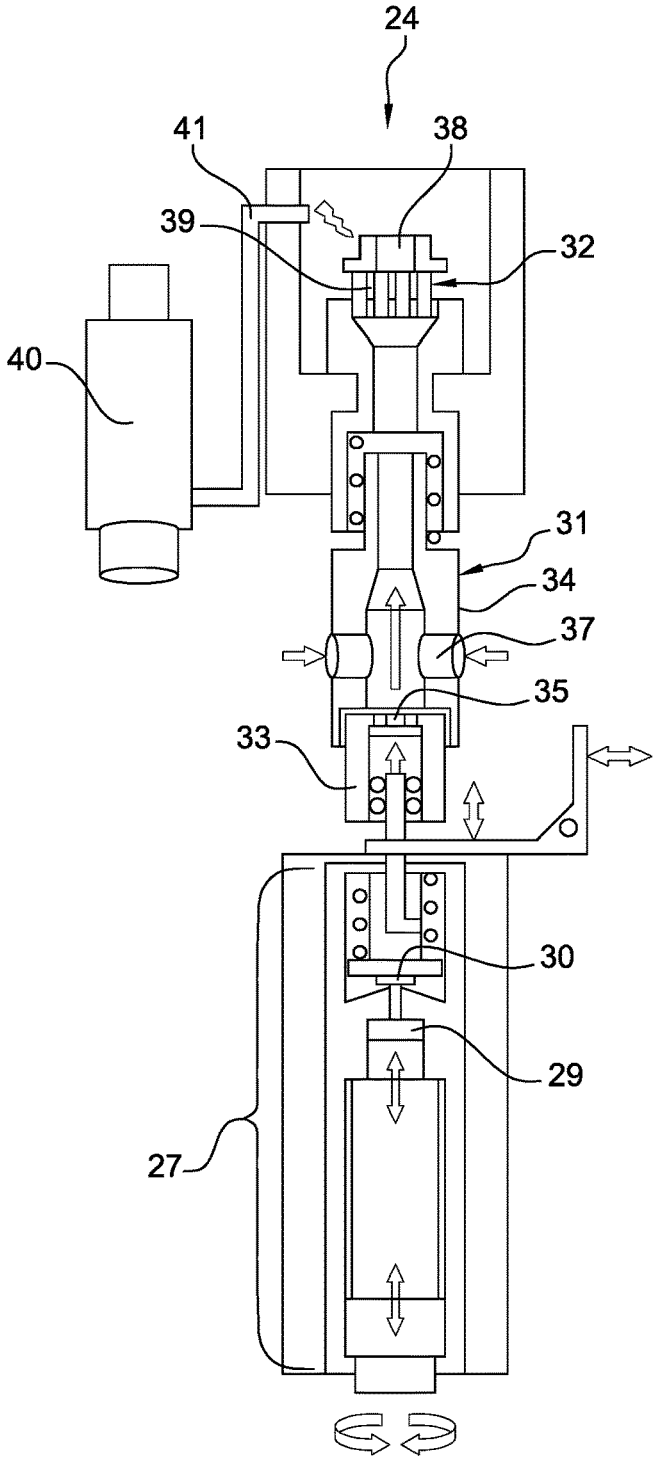

It is to be noted that the circuits shown in FIGS. 8A and 8B are as they generally appear in a lighter, but are not entirely reproduced in this form in a lighter 1 according to the invention. Only their principles of operation are retained in a lighter according to the invention.

DETAILED DESCRIPTION

Figure 1A:
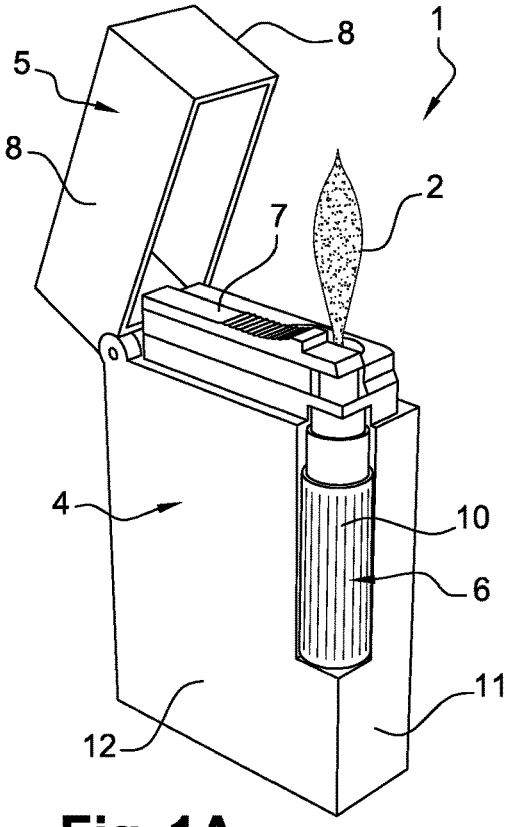
FIGS. 1A and 1B are two perspective views of a lighter according to the invention when open, respectively in a yellow flame configuration and in a turbo flame configuration.
Figure 1B:
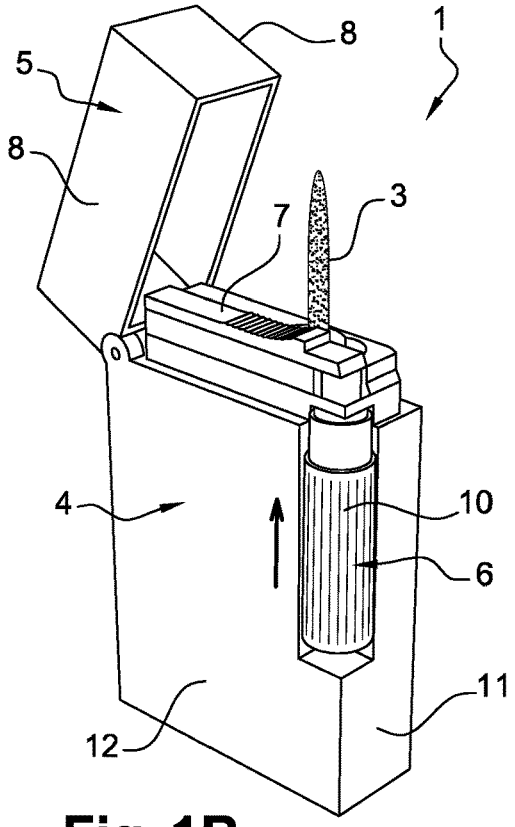
Figure 2:
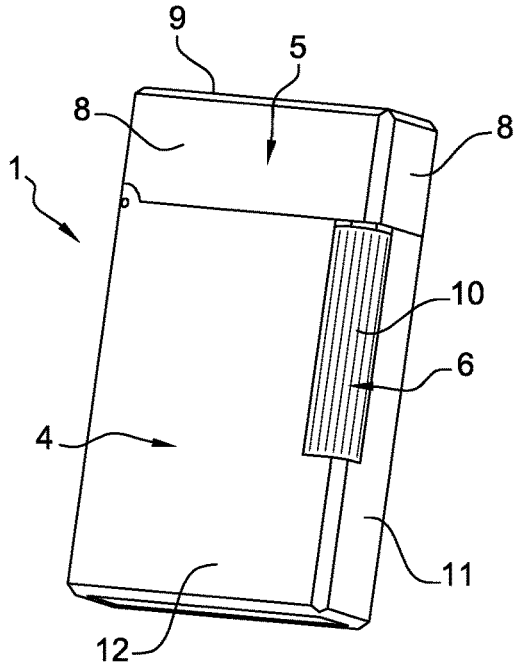
FIG. 2 is a perspective view of the lighter from FIGS. 1A and 1B in a closed configuration.

Referring to FIGS. 1A, 1B and 2, a lighter 1 according to the invention is able to produce alternately a classic yellow flame 2 and a blue flame 3 also known as a turbo flame or a torch flame. As a reminder and broadly speaking, the yellow flame or diffuse flame results from partial combustion of a fuel present in the lighter 1 with an oxidizer which is oxygen from the air, the air/gas mixture being formed after the gas has left the orifice of a burner. The blue flame is produced with a higher gas velocity and results from the total combustion of the fuel with the oxidizer, the air/gas mixture being formed before the gas exits the orifice of said burner.

The lighter 1 comprises a body 4, a pivoting cap 5 and a rotary driver 6. The body 4 is of substantially parallelepiped shape and encloses the operating mechanism of the lighter 1, said body 4 having in particular a face 7 through which the yellow flame 2 or the blue flame 3 is emitted. The cap 5 comprises four lateral walls 8 delimiting a rectangle and an upper wall 9 covering said four lateral walls 8. The cap 5 is able to pivot from a closed position, like that shown in FIG. 2 for example, to an open position like those shown in FIGS. 1A and 1B for example, the amplitude of the angular rotation to pass from one position to the other being less than 90°. The trainer 6 takes the form of a solid elongate cylindrical member delimited by an external surface having a plurality of parallel longitudinal ribs 10. The object of these ribs 10 is to increase the roughness of the external surface of the driver 6. The driver 6 is mounted in the body 4 of the lighter 1 at the level of an edge between two successive faces 11, 12 of said body 4 so that said driver 6 is flush with said two successive faces 11, 12. In other words, the driver 6 is completely included in the body 4 of the lighter 1 without adding to the dimensions of said body 4.

Referring to FIG. 2, the driver 6 is placed in the body 4 and mounted around an axis 19 of said body 4 so that said driver 6 extends perpendicularly to the cap 5 when the latter is in a closed position on the lighter 1. This axis 19 is its revolution axis and is parallel to a longitudinal axis of the driver 6.

Figure 7:
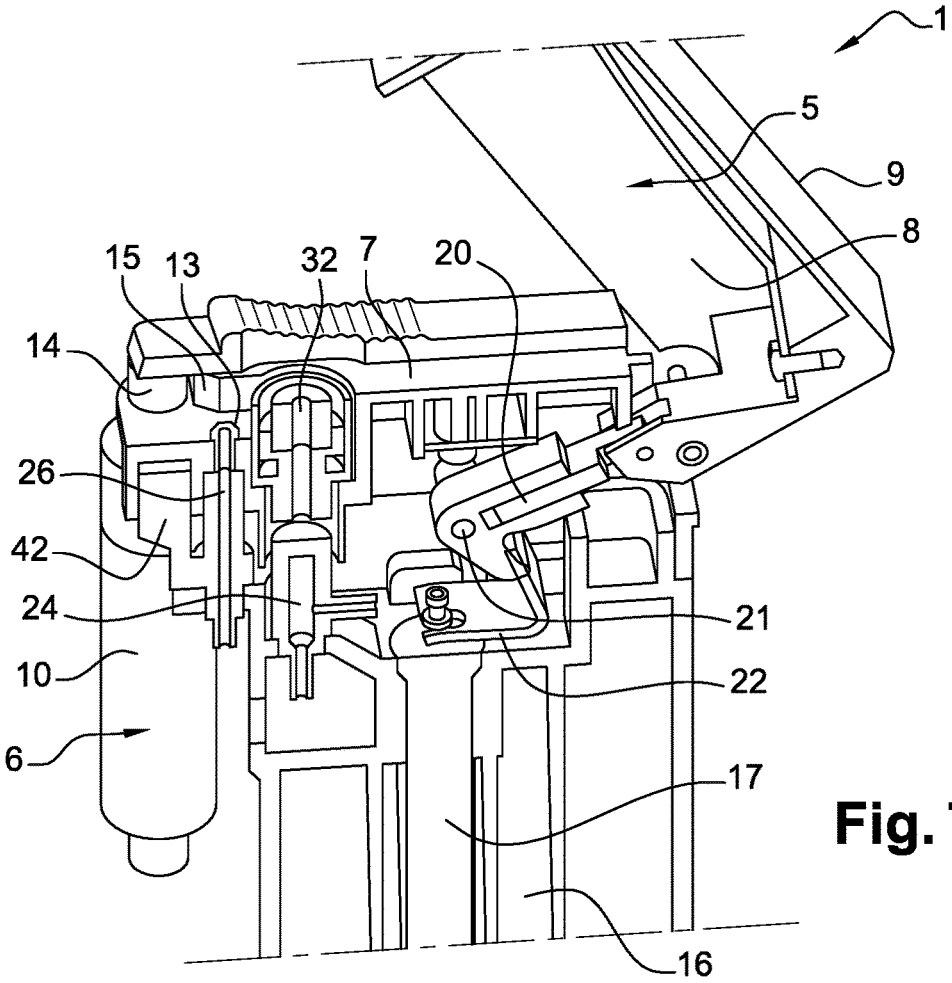
FIG. 7 is a perspective view of the mechanism of a lighter according to the invention showing in particular the opening of the gas container.

Referring to FIG. 7, the principal function of the driver 6 is to enable the generation of sparks at the level of a burner 13 intended to produce the yellow flame. The driver 6 is connected to a thumbwheel 14 that is in contact with a flint 15. In this way, sudden rotation of the driver 6 by means of a brief stroke with the thumb leads to rotation of the thumbwheel 14 which, in contact with the flint 15, generates sparks by friction with said flint 15.

Referring to FIG. 2, when the cap 5 is in a closed position on the lighter 1, it ideally extends the body 4 without introducing any difference of level therewith, improving the visual appearance of the lighter 1 and improving the "feel" for a user.

Figure 3:
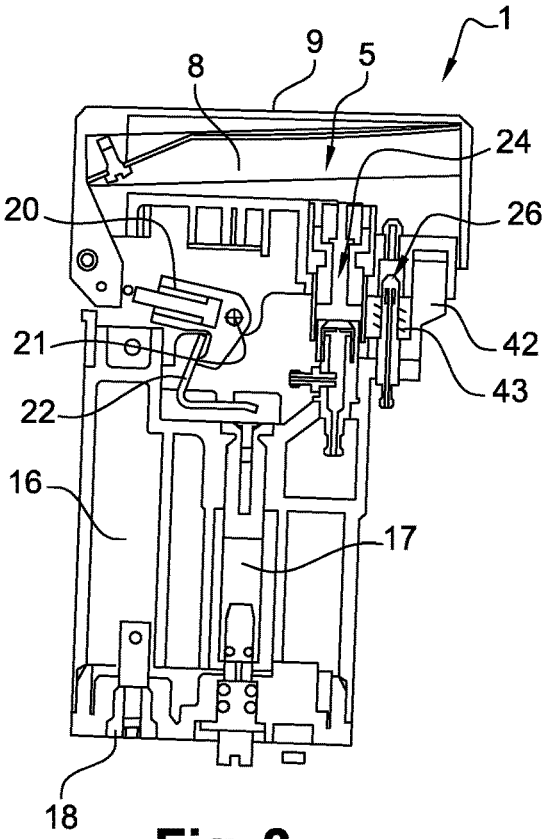
FIG. 3 is a simplified side view of a lighter according to the invention in a closed configuration.
Figure 4:
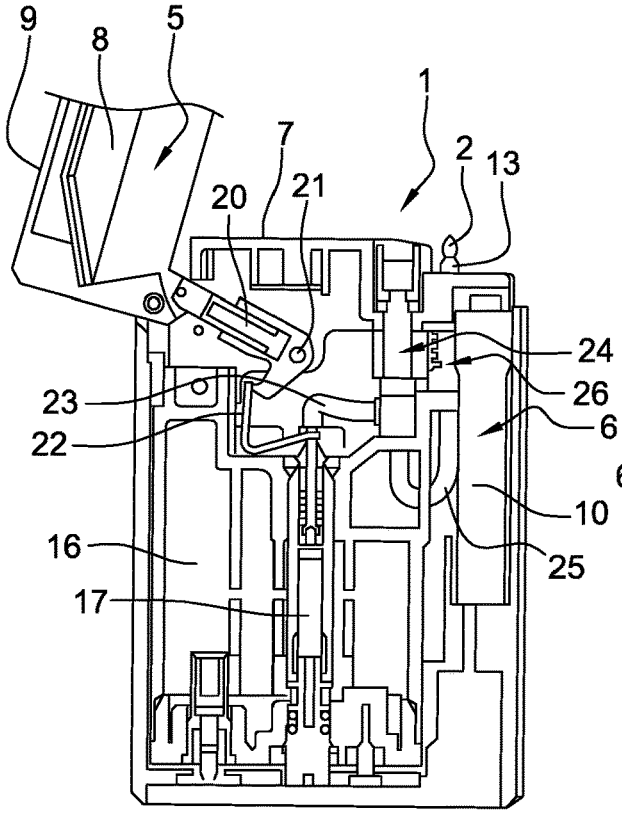
FIG. 4 is a side view of the operating mechanism of a lighter according to the invention in a yellow flame open configuration.

Referring to FIGS. 3 and 4, the body 4 of the lighter 1 comprises a container 16 of liquid fuel, provided with an opening 18 through which said fuel is introduced from outside of lighter 1. The liquid fuel may for example be constituted of a mixture of butane gas, isobutane and propane. This container 16 comprises an elongate closing member 17 able to slide between a closing position that retains the liquid fuel in said container 16 and an opening position allowing said liquid fuel to be released to circuits of the lighter 1 able to produce the different flames. The sliding of this closing member 17 between the closing and opening positions is effected by means of the cap 5.

In fact, referring to FIGS. 3, 4 and 7, the cap 5 is connected in an articulated manner to a first pivot member 20 able to pivot about a first axis 21, said first pivot member 20 being in contact with a second pivot member 22 fixed at a level of one end of the closing member 17. In this way, when the cap 5 is opened from its closing position shown in FIG. 2, it causes the two pivot members 20, 22 to pivot in accordance with a particular kinematic that is perfectly controlled, enabling the closing member 17 to slide between its closing position and its opening position. The liquid fuel can then circulate in the various flame production circuits of the lighter 1. The movement of the cap 5 is reversible, because return of said cap 5 into its closing position on the lighter 1 drives sliding in the opposite direction of the closing member 17, which finally blocks completely the fuel liquid container 16. In this way, the lighter 1 can function only when the cap 5 reaches its open position. In reality, by design, it is already able to function just before this open position is reached.

Referring to FIG. 4, the lighter 1 includes a first tube 23 connecting the liquid fuel container 16 to an upstream zone of a second circuit 24 able to generate the blue flame 3 and a second tube 25 connecting said upstream zone of the second circuit 24 to a first circuit 26 able to generate the yellow flame, said two circuits 25, 26 being separate and parallel in the lighter 1. The inside diameter of the first circuit 26 is greater than the inside diameter of the second circuit 24 and so the liquid fuel at the exit from the first tube 23 will naturally be oriented toward the first circuit 26 intended to produce the yellow flame 2. As the two circuits 24, 26 do not have a constant diameter, it would be more rigorous to mention a mean inside diameter. The lighter 1 has an adjuster screw able to regulate the flow rate of liquid fuel arriving in the first tube 23.

Referring to FIG. 8A, the first circuit 26 intended to provide the yellow flame 2 comprises from its upstream part to its downstream part an expansion valve 27, a gas channel 28 and the burner 13. The expansion valve 27 conventionally comprises an evaporator 29 and a mechanical obturator 30. The expansion valve 27 provided with the evaporator 29 has the function of changing the state of the fuel from liquid to gas by expansion. By altering the pressure ratio of the evaporator 29, it will be possible to regulate the expansion and therefore the flow rate of gas in the gaseous state, which is typically between 0.3 and 4 mg/s. The mechanical obturator 30, placed at the top of the expansion valve 27, controls the gas opening and allows the expansion process. The explosivity limits of the fuel (gaseous mixture of butane+isobutane+propane) in air (oxygen from the air being the oxidizer) depend on its composition, typically for butane between 1.8 and 8.4%.

The input of energy (a few millijoules are needed) to bring about the ignition of the fuel +oxidizing mixture is effected:

either with the aid of the steel thumbwheel 14 which rubs on the lighter flint 15 that is generally constituted of an alloy mixture "iron+cerium+rare earths" and generates a shower of sparks, or with the aid of a piezoelectric crystal which, as a result of an impact, generates a spark judiciously disposed between an electrode and the burner 13.

On leaving the obturator, the gas is conducted to the burner 13 by the channel 28 or a pipe. The fuel is then mixed with the oxidizer (oxygen from the air) at the level of the burner 13.

In the case of the yellow or diffuse flame, the combustion of the fuel with the oxidizer is partial.

Referring to FIG. 8B, the second circuit 24 intended to provide the blue flame 3 comprises from its upstream part to its downstream part the expansion valve 27 conventionally including the evaporator 29 and the mechanical obturator 30, a gas channel 31 and a diffusion element 32 for diffusing the blue flame 3. The gas channel 31 comprises an injector 33 and a segment 34 shaped to produce a Venturi effect. The injector 33 is a small chamber surmounted by a metal plate, this metal plate being pierced by a hole 35 the diameter of which is between 70 μm and 80 μm inclusive, typically 75 μm. The objective of the injector 33 is to accelerate the velocity at which the fuel escapes at the outlet of the 75 μm diameter hole 35. The escape velocity of the fuel will depend on the adjustment of the gas flow rate in the circuit 24. The fuel previously accelerated on passing through the injector 33 will create a reduced pressure on passing through the segment 34, shaped to produce a Venturi effect. This reduced pressure enables aspiration of surrounding air through the holes 37 disposed at the perimeter of the segment 34 adapted to produce the Venturi effect. This brings about premixing between the fuel and the oxidizer.

Figure 6:
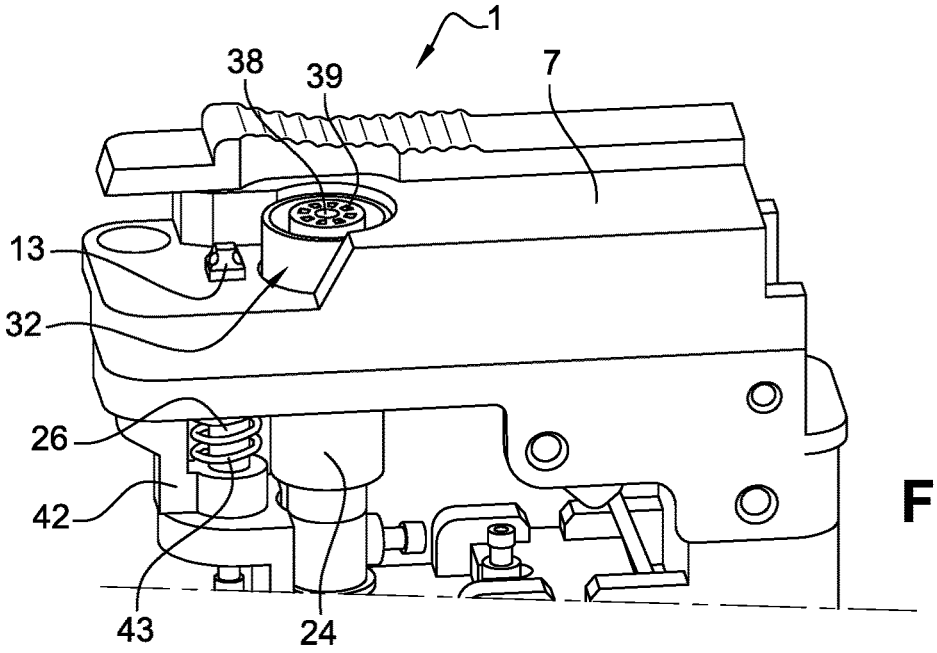
FIG. 6 is a perspective view of a zone of a lighter according to the invention including a yellow flame burner and a blue flame burner.

Referring to FIGS. 6 and 8B, the fuel+oxidizing mixture is conducted to the diffusion element 32, which is a burner having a central hole 38 and a ring of peripheral holes 39 disposed at the perimeter of the burner 32. The central hole 38 of the burner 32 makes it possible to obtain a blue flame in the form of a cone and the ring including the peripheral holes 39 makes it possible to obtain a "pilot" blue flame, which makes it possible to support the combustion in the cone.

Referring to FIG. 8B, an igniter device comprising for example a piezoelectric crystal 40 associated with an electrode 41 can supply the spark that will make it possible to obtain the blue flame at the level of the diffusion element 32.

In the case of the blue flame, the combustion of the fuel with the oxidizer is total.

Referring to FIG. 6, the burner 13 making it possible to obtain the yellow flame 2 and the diffusion element 32 making it possible to obtain the blue flame 3 are on the same face 7 of the lighter 1. There is a height difference between the burner 13 and the diffusion element 32, said diffusion element 32 emerging at a greater height than the burner 13. This height difference is typically between 1 and 3 mm. To be more precise, the burner 13 has two distinct orifices adapted to constitute two gas outlets for forming a yellow flame 2 in two parts, one of the two parts of said yellow flame 2 having a particular orientation enabling it to initiate the turbo flame 3. In this way the yellow flame is divided into two separate but continuous parts, said parts being judiciously disposed to enable the reversibility of the yellow flame 2 and the turbo flame 3. The two orifices of the first diffusion element 13 are preferably placed at 75° to one another. The part of the yellow flame 2 intended to initiate the turbo flame 3 and vice versa is advantageously disposed at 45° to said turbo flame 3.

Referring to FIGS. 3, 4, 5A and 5B, in a lighter 1 according to the invention the expansion valve 27 and the gas channel 28 of the first circuit 26 are produced in a blocking member 42 mounted to be mobile in translation in the body 4 of the lighter 1 by means of a preloaded spring 43. The driver 6 is not only mounted to rotate about its axis 19 in order to produce sparks but is also mounted to move in translation along said axis 19 in order to open or to close the first circuit 26. This blocking member 42 and the driver 6 are arranged in said body 4 so that the driver 6 is in contact with said blocking member 42 and so that by default, because of the preloaded spring 43, the blocking member 42 is in a position opening the first circuit 26 and pushes the driver 6 along its axis 19 into a first position. Consequently, movement in translation of the driver 6 from this first position drives movement in translation of the same amplitude of the blocking member 42 until the latter reaches the position closing the first circuit 26. The closing position of the blocking member 42 corresponds to a second position of the driver 6 along its axis 19. The movement in translation of the driver 6 to its second position requires some force, namely that necessary to compress the spring 43.

The driver 6 of a lighter according to the invention therefore has the benefit of two degrees of freedom: one in rotation to produce sparks in order to obtain a flame and the other in translation to move the blocking member 42 between a position opening the first circuit 26 and a position closing the latter in order to switch between the two circuits 24, 26.

A method of using a lighter 1 according to the invention comprises the following steps, assuming that the container 16 is already filled with a liquid fuel and that the cap 5 is in a closed position on the lighter 1:

an opening step by pivoting of the cap 5 in order to release the fuel liquid to the first tube 23. Since the diameter of the first circuit 26 is greater than that of the second circuit 24, and since by default, because of the preloaded spring 43, the blocking member 42 is in a position opening said first circuit 26, the fuel liquid will pass through the second tube 25 before entering said first circuit 26. In other words, the liquid fuel coming from the container 16 passes entirely through the first circuit 26. This step is shown in FIGS. 4 and 7.

A step of rotating the driver 6 about its axis 19, thanks to a rapid movement of the thumb on the rough surface of said driver 6, to obtain a diffuse yellow flame 2, produced at the level of the burner 13 placed at the outlet of the first circuit 26. This step is shown in FIGS. 1A and 4.

Figure 5A:
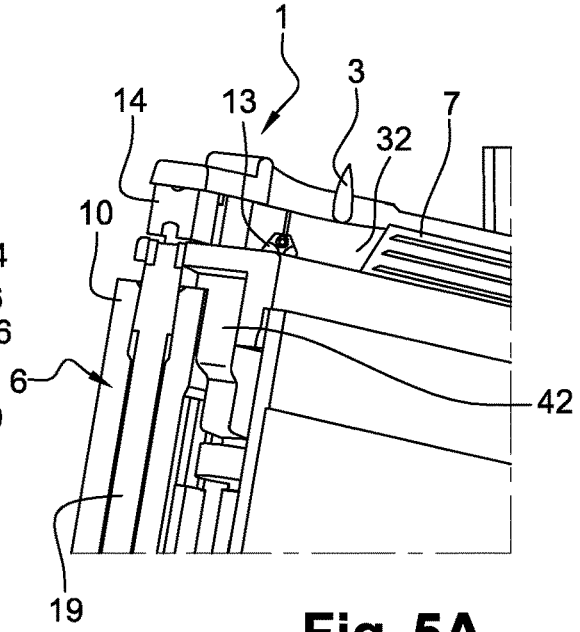
FIGS. 5A, 5B and 5C are respectively a perspective view, a side view and an enlarged view of the second circuit of a lighter according to the invention in a blue flame open configuration.
Figure 5B:
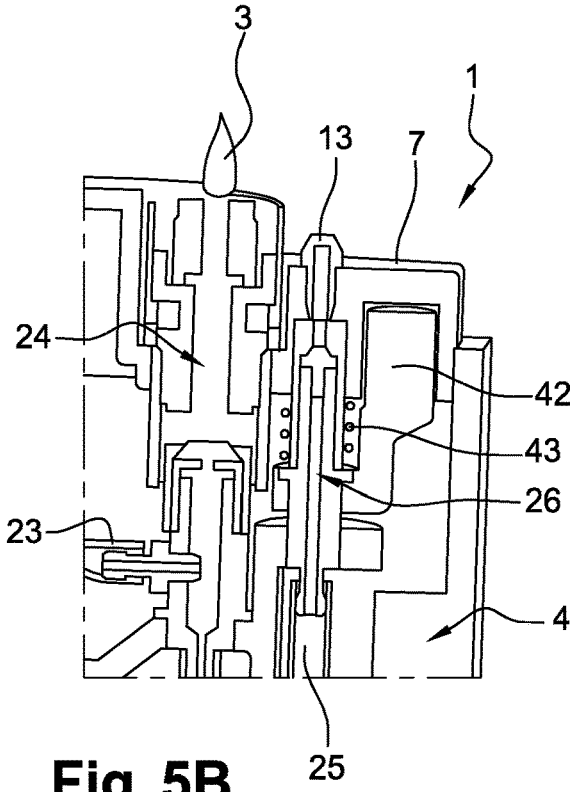
Figure 5C:
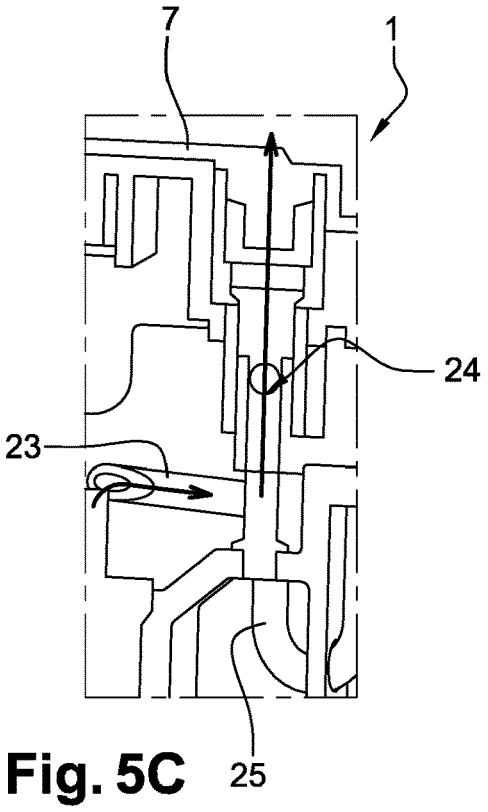

A step of moving the driver 6 in translation along its axis 19 to pass from the first position to the second position, thanks to simply pushing it with the thumb, this step being reflected in movement in translation of the blocking member 42 to a position closing the first circuit 26, since said driver 6 is in contact with said blocking member 42. The movement of the blocking member 42 requires a small force, that necessary to compress the preloaded spring 43. The closing of the first circuit 26 obliges the fuel liquid coming from the first tube 23 to pass through the second circuit 24. In this way, the yellow flame 2 initially formed and in the process of being extinguished (because the first circuit 26 is closed) makes it possible, before being extinguished, to initiate combustion of the blue flame 3 coming from the second circuit 24. In a lighter 1 according to the invention the blue flame 3 is therefore formed from the yellow flame 2 and it is not necessary to produce specific sparks to produce the blue flame 3. This step is shown in FIGS. 5A and 5B.

A step of maintaining the driver 6 in its new translated position for the time of using the blue flame 3.

A step of the thumb releasing the driver 6, reflected by an automatic return of said driver 6 to the first position because of the spring 43 associated with the blocking member 42, which has a natural tendency to expand. This step makes it possible to return instantaneously to a yellow flame 2, thanks to the blue flame 3 that is not yet extinguished.

The foregoing steps may be reproduced as many times as the user wishes, so long as there remains liquid fuel in the container 16 of the lighter 1.

Only closing the cap 5 onto the lighter 1 interrupts the supply of liquid fuel to the first or second circuit and stop the formation of the flames 2, 3.

The invention claimed is:

1. Lighter comprising:

a container of liquid fuel, a first gas circuit intended to produce a first type of flame and a second gas circuit intended to produce a second type of flame, said lighter further comprising a driver associated with a mechanism for producing sparks, activation in rotation of said driver generating sparks, wherein the driver, acting as a switch, is mounted in the lighter to be mobile in translation between a nominal first position in which it holds the first circuit open allowing the liquid fuel from the container to pass through said first circuit and thus to obtain the first type of flame and, after translation, a second position in which it blocks said first circuit switching to said second circuit, allowing said liquid fuel to pass only through the second circuit and thus to obtain the second type of flame.

2. Lighter according to claim 1, wherein the first circuit comprises a blocking member including at least part of the first circuit and mobile between a position opening and a position closing said first circuit, and in that the driver is in contact with said blocking member so that by default in the nominal first position the driver holds the blocking member in the opening position and so that movement in translation of said driver to its second position generates movement of the blocking member of the same amplitude to the closing position.

3. Lighter according to claim 2, wherein the blocking member is associated with a preloaded spring enabling said blocking member to be held by default in the opening position and consequently the driver to be held by default in its first position.

4. Lighter according to claim 3, wherein movement of the driver from its nominal first position to its second position generates movement of the blocking member to its closing position accompanied by compression of the spring.

5. Lighter according to claim 1, wherein the maximum travel of the driver (6) between the first position and the second position is between 0.5 mm and 3 mm inclusive.

6. Lighter according to claim 1, wherein the driver is an elongate cylindrical member and in that the movement in translation of said driver in the lighter is affected along at revolution axis.

7. Lighter according to claim 1, wherein the first type of flame is a yellow flame and the second type of flame is a flame other than said yellow flame.

8. Lighter according to claim 7, wherein the first circuit terminates at a first diffusion element at the level of which the yellow flame is produced and in that the second circuit terminates at a second diffusion element at the level of which the flame, other than said yellow flame, is produced, said two elements emerging from the same face of the lighter, said second element emerging at a height greater than that of said first element.

9. Lighter according to claim 8, wherein the first diffusion element has two distinct orifices able to produce a yellow flame in two continuous parts and in that one of the two parts of said yellow flame has an orientation enabling it to initiate the flame, other than said yellow flame.

10. Lighter according to claim 8, wherein the height difference between the first diffusion element and the second diffusion element is between 1 mm and 3 mm inclusive.

11. Lighter according to claim 1, wherein the container of liquid fuel is blocked by a closing element and in that the lighter includes a pivoting cap connected to said closing element by a relay member, opening the cap driving movement of the closing element via said relay member to release the gas to the first circuit or the second circuit.

12. Method of using a lighter according to claim 1, wherein said method comprises the following steps,

- a step of filling the container of the lighter with a liquid fuel,
- a step of opening the cap in order to release the gas to the first and second circuits of the lighter,
- a step of rotating the driver so as to produce sparks and to obtain the first type of flame,
- a step of movement of the driver in translation between the first position and the second position in order to block the first circuit and to activate the second circuit in order to obtain the second type of flame.

* * * * *